US006214114B1

(12) United States Patent
Kawabe et al.

(10) Patent No.: US 6,214,114 B1
(45) Date of Patent: Apr. 10, 2001

(54) JET COATING APPARATUS

(75) Inventors: Shigetoshi Kawabe; Hiroyuki Aizawa; Seiichi Tobisawa, all of Hino (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/023,843

(22) Filed: Feb. 13, 1998

(30) Foreign Application Priority Data

Feb. 21, 1997 (JP) ..... 9-037722
Sep. 8, 1997 (JP) ..... 9-242656

(51) Int. Cl.[7] ..... B05C 5/02

(52) U.S. Cl. ..... 118/325; 118/407; 118/410; 118/419

(58) Field of Search ..... 118/407, 410, 118/419, 325; 427/356; 425/141, 466

(56) References Cited

U.S. PATENT DOCUMENTS

| | | | |
|---|---|---|---|
| 4,416,214 | 11/1983 | Tanaka et al. . | |
| 4,854,262 | 8/1989 | Chino et al. . | |
| 5,206,056 | 4/1993 | Shibata et al. . | |
| 5,226,963 | 7/1993 | Shibata et al. . | |
| 5,536,313 | 7/1996 | Watanabe et al. . | |
| 5,700,325 * | 12/1997 | Watanabe | 118/411 |

FOREIGN PATENT DOCUMENTS

| | | |
|---|---|---|
| 0 542 635 A1 | 5/1993 | (EP) . |
| 0 557 769 A1 | 9/1993 | (EP) . |
| 0 678 341 A2 | 10/1995 | (EP) . |
| 0 744 221 A2 | 11/1996 | (EP) . |
| 48-98803 | 12/1973 | (JP) . |
| 61-111168 | 5/1986 | (JP) . |
| 62-124631 | 6/1987 | (JP) . |
| 63-20070 | 1/1988 | (JP) . |
| 63-88080 | 4/1988 | (JP) . |
| 1-203075 | 8/1989 | (JP) . |
| 1-224071 | 9/1989 | (JP) . |
| 2-251265 | 10/1990 | (JP) . |
| 6-254466 | 9/1994 | (JP) . |
| 6-508571 | 9/1994 | (JP) . |

OTHER PUBLICATIONS

English language Abstract only.

* cited by examiner

*Primary Examiner*—Laura Edwards
(74) *Attorney, Agent, or Firm*—Frishauf, Holtz, Goodman, Langer & Chick, P.C.

(57) ABSTRACT

A coating apparatus includes: a conveyor for conveying an object to be coated; and a coater for coating a coating liquid by jetting the coating liquid from a slit in a film shape and by causing the coating liquid to collide with the object to be coated. The coater is not in contact with the object to be coated, and a clearance of a slit exit d (m) of the coater satisfies a relation of $0<d\leqq 5\times10^{-5}$ (m). The clearance of the slit exit of the coater is smaller than a clearance of a slit inlet through which the coating liquid is injected, the slit has, on a side of the slit exit, slit side surfaces which face each other to be in parallel.

6 Claims, 3 Drawing Sheets

PRIOR ART

JET COATING APPARATUS

BACKGROUND OF THE INVENTION

The present invention relates to a coating method and a coating apparatus, and in particular, to a coating method and a coating apparatus both employing a coater which coats a coating liquid extruded toward the surface of an object to be coated in movement on the surface of the object to be coated to be in constant thickness on a high speed thin layer coating basis. The object to be coated may also be called a support hereinafter.

Various methods to coat a coating liquid on the surface of a flexible support have been studied to be put in practice so far. Among these various coating methods, a coating method by means of a coater of an extrusion type wherein a coating liquid extruded continuously toward the surface of a moving support is coated on the surface of the support to be in constant thickness on a high speed thin layer coating basis is superior to other coating methods of a roll type such as a reverse roll coating, a kiss-roll coating and a gravure-roll coating, for example, on the various points of uniformity of coating, thin layer coating and a range of coating speed available. The coating method by means of a coater of an extrusion type makes a simultaneous multi-layer coating through the so-called wet on wet coating to be possible, and it is effective in terms of cost and performance for the application to manufacture of recent coated products with high value added.

As a conventional coater of an extrusion type, Japanese Tokkaishos 48-98803 and 61-111168, for example, disclose a manufacturing method for magnetic recording media through wet on wet simultaneous multi-layer coating wherein coating liquids superposed in advance are coated on the support which is held on a back roll and is running continuously.

Further, there has been devised a method as that disclosed in Japanese Tokkaisho 62-124631 wherein an upper layer is coated on a support while a lower layer is still wet, without the support of a back roll, by using a coater of a single layer extrusion type, and has been devised a coater head provided with slits from which two coating liquids are extruded as that disclosed in Japanese Tokkaisho 63-88080 and Japanese Tokkaihei 2-251265.

In addition, there has been devised a method as that disclosed in Japanese Tokkaihei 1-203075 and Japanese Tokkaihei 6-254466 wherein a diameter of a support roll positioned directly before or just behind an extrusion type coater is changed to correct a wrinkle caused by the slack in the lateral direction of a support, and a method as that disclosed in Japanese Tokkaihei 1-224071 wherein a means to pressurize a fluid from the back side of a support is provided for the purpose of uniformalizing a wrinkle caused by the slack portion.

It has also been devised a method as that disclosed in WO 92/22418 wherein a pocket portion and a slit portion of an extrusion type coater are changed in terms of shape in the lateral direction for the purpose of uniformalizing the coating liquid flow rate in the lateral direction.

It has further been devised an apparatus as that disclosed in Japanese Tokkaisho 63-20070 wherein there is used an extrusion type coater coating a high viscosity liquid while holding a support with a back roll in which a dimension of a slit is gradually reduced as it approaches a nozzle for a coating liquid, and thereby a pressure loss is reduced to make the coating at high viscosity possible.

However, these methods and apparatuses in prior art have problems that a wrinkle caused by the slack of a support affects, coating streaks are caused by dust in the circumstance and by flocculated substances in a coating liquid, and high speed coating is impossible. In particular, there have not existed an apparatus and a method which make it possible to coat, on a thin wet layer basis, a coating liquid at high speed without being affected by a wrinkle caused by the slack of a support and without creating coating streaks.

SUMMARY OF THE INVENTION

An object of the invention is to provide a coating apparatus capable of coating at high speed without being affected by a wrinkle caused by the slack of a support and without creating coating streaks.

The object stated above can be attained by either one of the following structures (1)–(8).

(1) A coating apparatus having therein the following structures such as a conveyance means to convey an object to be coated and a coater to coat the coating liquid by jetting the coating liquid from a slit in a film shape and by causing the coating liquid to collide with the object to be coated, wherein the coater is not in contact with the object to be coated, and a clearance of a slit exit d (m) of the coater satisfies the relation of $0<d\leqq 5\times 10^{-5}$ (m), and the slit exit clearance of the coater is smaller than a clearance of a slit inlet through which the coating liquid is injected, and side surfaces which face each other and are in parallel with each other are provided at the slit exit.

(2) The coating apparatus according to Structure (1) above wherein coating speed U (m/s), coated layer wet thickness hw (m) and the clearance of slit exit d (m) are determined so that dimensionless number M expressed by the following expression may satisfy the following relation $$M=(\rho\cdot U\cdot hw^2)/(\mu\cdot d)>0.2$$

when viscosity of the coating liquid is represented by $\mu$ (Pa·s) and density of the coating liquid is represented by $\rho$ (kg/m$^3$).

(3) The coating apparatus according to Structure (1) above wherein a clearance between the slit exit and the object to be coated is at least 2.5 times the coated layer wet thickness or more.

(4) The coating apparatus according to Structure (1) above wherein the coating liquid jetted in a shape of a film forms a cross-link portion in a film shape between the coater and the object to be coated.

(5) The coating apparatus according to Structure (1) above wherein slit side surfaces on the side of the slit exit are formed by the member whose Vickers hardness is not less than 280.

(6) A coater to coat a coating liquid wherein the coating liquid is jetted in a shape of a film from a slit to collide with the object to be coated, wherein clearance d (m) on the side of a slit exit of the coater satisfies the relation of $0<d\leqq 5\times 10^{-5}$ (m), and the slit exit clearance of the coater is smaller than a clearance of a slit inlet through which the coating liquid is injected, and slit side surfaces which face each other and are in parallel with each other are provided at the slit exit.

(7) The coater according to Structure (6) wherein the slit side surfaces on the side of the slit exit is formed by the member whose Vickers hardness is not less than 280.

(8) The coater according to Structure (6) wherein the slit side surfaces which face each other to be in parallel on the side of the slit exit are formed by the member whose Vickers hardness is not less than 280.

DETAILED DESCRIPTION OF THE INVENTION

Figure 1:
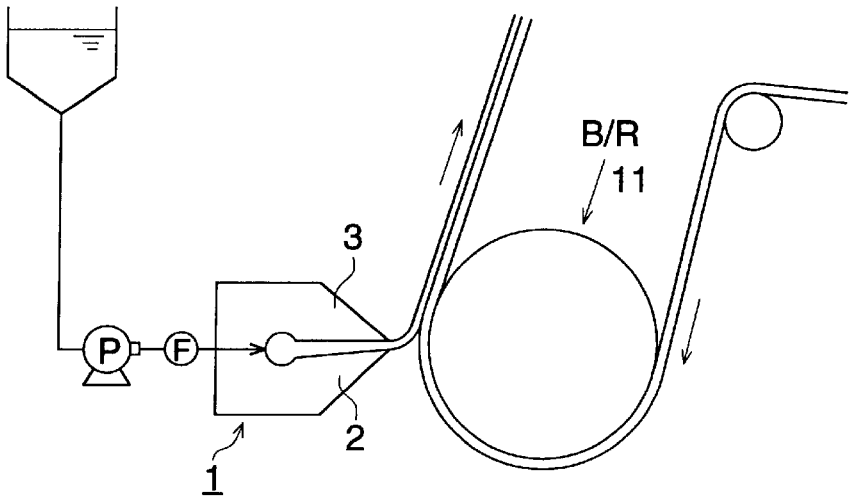
FIG. 1 is a side cross-sectional view showing an embodiment of a coater provided on a coating apparatus of the invention.
Figure 2:
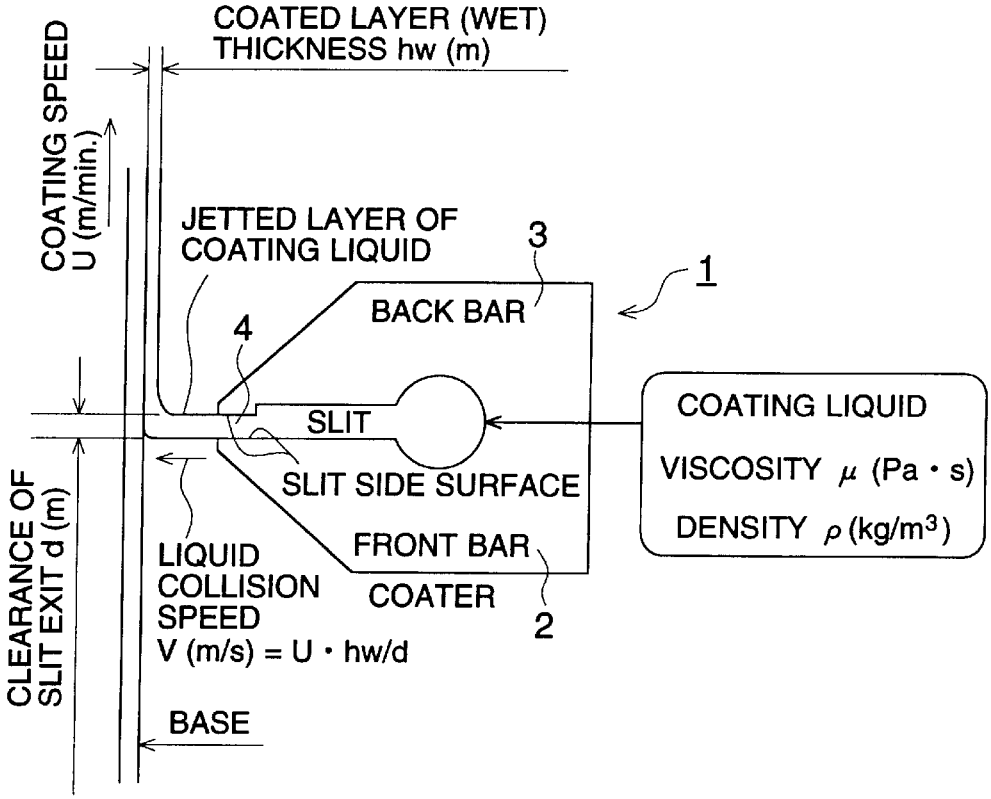
FIG. 2 is a side cross-sectional view showing the relation between factors of coating conditions for a coater provided on a coating apparatus of the invention.

Inventors of the invention found that it is possible to coat stably, even when coating a coating liquid at high speed, without having dust that is caught between a tip of a coater and a support, without creating streaks, and without being affected by a wrinkle caused by the slack of the support, by making the coating liquid to jet by decreasing a clearance of a slit exit of an extrusion type coater to 50 $\mu$m or less, preferably to less than 20 $\mu$m to be much smaller than that in a conventional extrusion type coater as shown in a side sectional view in FIG. 1 or FIG. 2, and by providing side surfaces which face each other and are in parallel with each other at the slit exit, and by making the clearance of the slit exit to be smaller than that of the slit inlet, and by coating with a cross-link portion formed by causing the jetted film of coating liquid to collide with a support conveyed while being away to be farther than in a conventional extrusion type coater.

After the intensive studies of the relations between factors shown in FIG. 2 about the conditions for coating, by jetting a coating liquid in a shape of a film, and by causing the jetted film of coating liquid to collide with a support conveyed while being away to be farther than in a conventional extrusion type coater, and thereby by forming a cross-link portion, the inventors found that the quality of coating depends to a great extent on dynamic pressure of a coating liquid jetted in a shape of a film and viscosity resistance of the coating liquid, and the ratio of dynamic pressure/viscosity resistance which is greater than 0.1 makes stable coating possible.

When coating a coating liquid having viscosity $\mu$ (Pa·s) and density $\rho$ (kg/m$^3$) with a coater having a clearance of slit exit d (m) at coating speed U (m/s) on a basis of coated layer wet thickness hw (m), dynamic pressure P (Pa) is expressed as follows, $$P=\rho V^2/2=\rho(U\cdot hw/d)^2/2$$

on the assumption that jetting speed for a coating liquid is represented by V (m/s).

Since the viscosity resistance of a coating liquid shown at the moment when the coating liquid is coated on a support is calculated roughly with $\mu U/d$, when the conditions satisfying the following relations are used for coating, it is possible to coat stably.

$$\text{Dynamic pressure/viscosity resistance}=(\rho(U\cdot hw/d)^2/2)/(\mu U/d)=(\rho\cdot U\cdot hw^2)/(2\mu\cdot d)>0.1$$

therefore, $$(\rho\cdot U\cdot hw^2)/(\mu\cdot d)>0.2$$

To make assurance doubly, hw represents a coated layer wet thickness, and it does not mean h×w. Therefore, hw$^2$ is not h×w×w but is (hw)$^2$ apparently. Incidentally, $(\rho\cdot U\cdot hw^2)/(\mu d)$ in this case is a dimensionless number.

Figure 3:
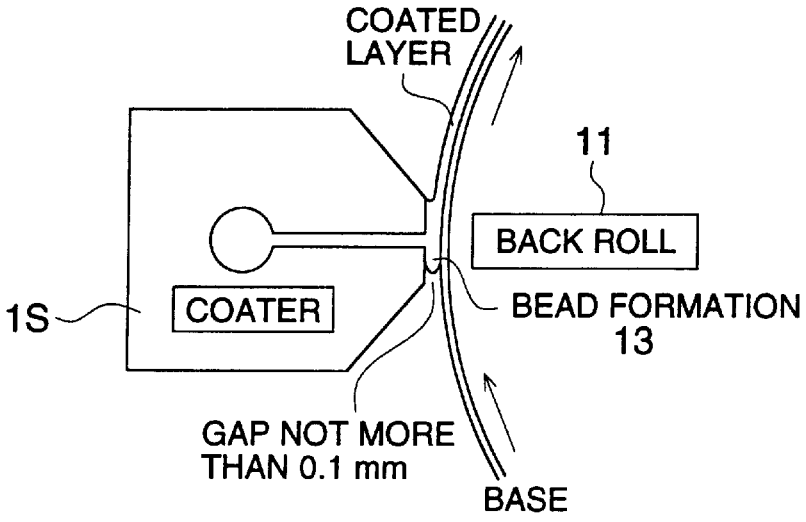
FIG. 3 is a side cross-sectional view showing how coating is conducted by a conventional coater of an extrusion type.

In the present invention, a coating liquid jetted in a film shape is caused to collide with a support for coating. Therefore, as long as the jetted film reaches the support, a distance between a tip of a coater and the support has no influence, and it is not necessary to make that distance to be as extremely small as two times the coated layer wet thickness or less, which is different from the occasion of a conventional extrusion type coater employing a back roll shown in a side cross-sectional view in FIG. 3. Therefore, it is possible to prevent that foreign materials on a support or in a coating liquid which can cause streak problems are caught in a coater, and thereby to eliminate occurrence of streaks completely, by setting the above-mentioned distance to 2.5 times the coated layer thickness or more, preferably to 5 times the coated layer thickness or more. Incidentally, as a conveyance means, a driving roll rotated by a motor is common. The driving roll includes a nip roll, a roll which comes in contact with only one side and a suction roll, and a material of the driving roll includes various types such as rubber, metal and ceramics. The conveyance means is not limited naturally to the foregoing. In addition, the invention makes stable and high speed coating possible. As high speed coating, coating speed of 100 m/s or more is preferable, 300 m/s or more is more preferable, 500 m/s or more is still more preferable, and if possible, 1000 m/s is furthermore preferable.

Further, since an edge portion of an extrusion type coater is completely away from a support, there is generated no pressure distribution caused by bending or a wrinkle caused by the slack of a support, making it possible to obtain coated layer thickness which is extremely uniform. In the invention, it is possible to conduct satisfactory coating even when no back roll is used if a wrinkle caused by the slack of a support is flattened to a certain extent by the conveyance tension which is slightly high as shown in FIG. 2, although it is more preferable that a support in the vicinity of coating area is flattened by the use of a back roll as shown in FIG. 1.

In the case of a high viscosity liquid, it is impossible to make hw small without making clearance of slit exit d small, because viscosity $\mu$ in the expression stated above is great. Namely, thin layer coating is difficult. However, slit resistance which is extremely great in this case, namely a great pressure loss in this case requires the liquid-feeding pressure which is very high, and a liquid-feeding means such as a gear pump used commonly caused problems of a fall of flow rate, pulsatory motion and pump troubles. As measures to solve these problems, it is effective to expand a clearance of slit entrance and thereby to make the slit to narrow gradually toward its exit side from the entrance side, in place of narrowing the clearance of slit exit. For thin layer coating, the clearance of slit exit is required to be 50 $\mu$m or less, and the clearance of less than 20 $\mu$m is preferable, in which the clearance of slit entrance is preferably 100 $\mu$m or more to overcome a fall of pressure.

Figure 4:
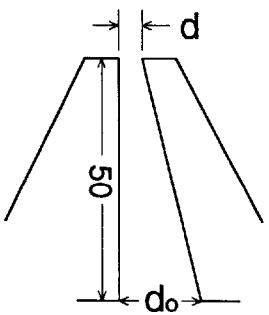
FIGS. 4(*a*)–4(*d*) represent partially enlarged diagrams showing slit shapes of coaters provided on a coating apparatus of the invention and coaters in comparative examples.
Figure 4:
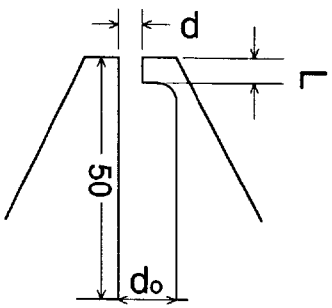
Figure 4:
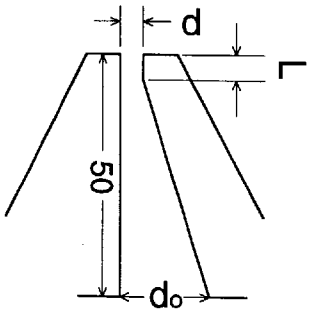
Figure 4:
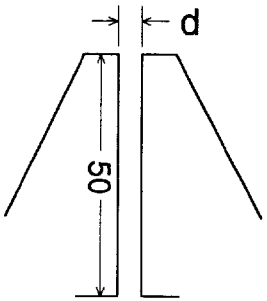

In this narrowing method, a slit has been formed to be gradually narrowed by means of taper. In this method, however, layer thickness distribution in the lateral direction for coating is made to be ill-balanced, which has been a problem. However, inventors of the invention found that a slit surface of a front bar and that of a back bar which are in parallel each other in place of being tapered at slit exit portions both provided as shown in FIGS. 4(*b*) and (*c*) make machining easy and improve straightness, make it possible to form a jetted film which is more uniform, and improve distribution of coated layer thickness in the lateral direction of coating. In the case of a coater which is structured by at least three bars and coats two layers or more, there are provided slit surfaces which are in parallel each other at the exit portion of the slit formed by adjoining bars.

It was found that when a clearance of slit exit is narrowed to be smaller than that in a conventional extrusion type coater, abrasives or metallic powder, when they are contained in a coating liquid, flow in the slit at high speed and roughen an inner wall of the slit, causing deterioration of coated layer thickness distribution and troubles of foreign materials sticking to coated layers, and shorten the life of a coater. However, it was found that the foregoing can be prevented by using a member having high hardness with regard to a material of a slit for the portion where the slit clearance is smallest in the vicinity of the slit exit. This hardness, when it shows Vickers hardness of 280 or higher, is acceptable in practical use, though it depends upon a coating liquid to be used. Though it is preferable that entire surfaces of the slit are covered with this member, it is also acceptable in practical use that only parallel portions at a slit exit where the slit is small are entirely structured with members having Vickers hardness of 280 or more. Further, even when only parallel portions closest to the slit exit are structured with members having Vickers hardness of 280 or more, it is also possible to prevent deterioration of coated layer thickness distribution caused by abrasion and uneven and non-uniform coating, to a certain extent. This method is helpful for cost reduction when processing for enhancing hardness is expensive. Further, it is preferable for its object to structure both surfaces of front bar 2 and back bar 3 of slit 4 with members having Vickers hardness of 280 or more. Incidentally, it is preferable that jetting speed of a coating liquid jetted in a film shape at which the coating liquid leaves the slit exit is mostly the same as colliding speed at which the coating liquid collides against an object to be coated. It is further preferable to provide a filter at a coating liquid inlet of a slit of a coater so that dust and foreign materials greater than a clearance of slit exit may not enter the slit.

EXAMPLES

An example of each of the structures of the invention will be shown below. Incidentally, though a coater similar to a conventional extrusion type coater is used, a coating apparatus can employ coaters of any types provided that coating satisfying the conditions of the invention is possible. Incidentally, a coater having a shape shown in FIG. 4(*b*) was used for all Examples except Example 2.

As a coating liquid to be used in each example below, latex coating liquid, carbon-dispersed liquid, magnetic coating (1) and magnetic coating (2) are used, and these coating liquids are prepared as follows. In addition to magnetic coating (1) and magnetic coating (2), pure water, acetone and cyclohexanone were also used as a simulation liquid.

| Latex coating liquid | |
|---|---|
| Copolymer latex (solid matters 30%) (described below) | 270 g |
| Butylacrylate 40 wt% | |
| Styrene 20 wt% | |
| Glycidylmethacrylate 40 wt% | |
| Following compounds (UL-1) | 0.6 g |
| Hexamethylene-1,6-bis (ethylene urea) | 0.8 g |
| Water added to make 1 liter | |
| UL-1 | |

-continued

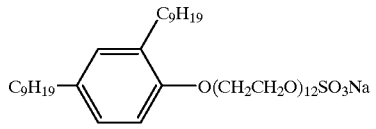

| Carbon-dispersed liquid | |
|---|---|
| Carbon black (Laven 1035) | 30 parts |
| Barium sulfate (average particle size 300 nm) | 10 parts |
| Nitrocellulose | 25 parts |
| Polyurethane resin (N-2301 made by Nihon Polyurethane Co.) | 25 parts |
| Polyisocyanate compound (Colonate L made by Nihon Polyurethane Co.) | 10 parts |
| Cyclohexanone | 400 parts |
| Methyl ethyl ketone | 250 parts |
| Toluene | 250 parts |

| Magnetic coating (1) | |
|---|---|
| Co-γ-$Fe_2O_3$ (Hc: 900 oersted, BET value: 45 $m^2/g$)) | 10 parts |
| Diacetyl cellulose | 100 parts |
| α-alumina (average grain size: 0.2 μm) | 5 parts |
| Stearic acid | 3 parts |
| Carnauba wax | 10 parts |
| Cyclohexanone | 100 parts |
| Acetone | 200 parts |

| Magnetic coating (2) | |
|---|---|
| Ferromagnetic metallic powder (average major axis: 0.15 μm, $\sigma_s$: 1.25 emu/g, axial ratio: 8, pH: 9.5, crystal size: 145Å, Hc: 1700 Oe, BET: 53 $m^2/g$) | 40 parts |
| Potassium sulfonate radical-containing vinylchloride resin (MR-110 made by Nihon Zeon Co.) | 10 parts |
| Sodium sulfonate radical containing polyurethane resin (UR-8700 made by Toyo Boseki Co.) | 10 parts |
| α-alumina (0.15 μm) | 8 parts |
| Stearic acid | 1 part |
| Butylstearate | 1 part |
| Cyclohexanon | 100 parts |
| Methyl ethyl ketone | 100 parts |
| Toluene | 100 parts |

A PET base having a thickness of 100 μm was used as a support.

Example 1

A distance between a coater and a support was set to 0.5 mm, and types of coating liquids (including viscosity and density), a coated layer thickness, coating speed and a clearance of slit exit of an extrusion type coater were changed variously to confirm whether coating can be performed in a stable manner.

TABLE 1

| | Name of coating liquid | Viscosity $\mu$ ($10^{-3}$ Pa · S) | Density ρ (Kg/m$^3$) | Coated layer thickness hw ($\mu$m) | Coating speed U (m/min) | Clearance of slit exit d ($\mu$m) | Quality of coating |
|---|---|---|---|---|---|---|---|
| Example 1-1 | Pure water | 1 | 1000 | 5 | 100 | 10 | A |
| Example 1-2 | Pure water | 1 | 1000 | 5 | 100 | 25 | A |
| Example 1-3 | Pure water | 1 | 1000 | 1 | 500 | 25 | A |
| Example 1-4 | Pure water | 1 | 1000 | 1 | 1000 | 25 | A |
| Example 1-5 | Pure water | 1 | 1000 | 5 | 100 | 50 | A |
| Comparative Example 1-1 | Pure water | 1 | 1000 | 5 | 100 | 75 | B |
| Comparative Example 1-2 | Pure water | 1 | 1000 | 5 | 100 | 100 | B |
| Comparative Example 1-3 | Pure water | 1 | 1000 | 5 | 100 | 300 | C |
| Example 1-6 | Latex | 1.2 | 997 | 5 | 100 | 25 | A |
| Example 1-7 | Latex | 1.2 | 997 | 1 | 500 | 25 | A |
| Example 1-8 | Latex | 1.2 | 997 | 1 | 1000 | 25 | A |
| Example 1-9 | Latex | 1.2 | 997 | 5 | 100 | 50 | A |
| Comparative Example 1-4 | Latex | 1.2 | 997 | 5 | 100 | 75 | B |
| Comparative Example 1-5 | Latex | 1.2 | 997 | 5 | 100 | 100 | B |
| Comparative Example 1-6 | Latex | 1.2 | 997 | 5 | 100 | 300 | C |
| Example 1-10 | Acetone | 0.37 | 790 | 2.5 | 100 | 25 | A |
| Example 1-11 | Acetone | 0.37 | 790 | 2.5 | 100 | 50 | A |
| Comparative Example 1-7 | Acetone | 0.37 | 790 | 2.5 | 100 | 75 | B |
| Comparative Example 1-8 | Acetone | 0.37 | 790 | 2.5 | 100 | 100 | C |

Note Quality of coating A: Stable coating is possible.
B: Coating is stable after cross-linking of a jetted coating liquid film which, however, is difficult.
C: Coating is impossible or unstable.

As a result, it is understood, as shown in Table 1, that stable coating is possible when a clearance of slit exit is not more than 50 $\mu$m and is smaller than a clearance of a slit inlet and slit side surfaces which face each other and are in parallel with each other are provided. This indicates that the invention has an excellent effect that stable coating fo a thin layer at high speed is possible.

Example 2

Coating was conducted at coating speed of 100 m/min with coated layer of 10 $\mu$m while changing shapes of coater slit portions and dimensions, and layer thickness distribution, pressure loss in the coater and quality of coating (a lower limit of layer thickness at the coating speed of 100 m/min was also measured) were confirmed.

The results of the example are shown in Tables 2 and 3 which indicate that layer thickness distribution is excellent, pressure loss in the coater is small, and coating is stable, when a clearance of slit exit is 0.05 mm or less, parallel portions are provided at the slit exit, and the slit entrance side is broadened. It is further confirmed that coating with thinner layer thickness can be realized when a clearance of slit exit is made to be 0.015 mm or less while keeping the conditions mentioned above.

Incidentally, a coating liquid in Table 2 is magnetic coating (1), and a coating liquid in Table 3 is a carbon-dispersed liquid. With regard to shapes of slit portions, those of a taper type, a step type, a type of parallel+taper, and of a parallel type as shown in FIGS. 4(*a*), 4(*b*), 4(*c*) and 4(*d*) were used.

TABLE 2

| | Length of parallel portion in slit (nm) | Clearance of slit exit d(mm) | Clearance of slit entrance dO(nm) | Shape of slit portion | Layer thickness distribution (%) | Pressure loss (kgf/cm$^2$) | Quality of coating |
|---|---|---|---|---|---|---|---|
| Comparative Example 2-1-1 | 31.2 | 0.015 | 0.015 | Parallel | — | 10 or more | C |
| Comparative Example 2-1-2 | 14.8 | 0.015 | 0.015 | Parallel | — | 7.5 | C |
| Comparative Example 2-1-3 | 9.7 | 0.015 | 0.015 | Parallel | — | 5.0 | C |
| Example 2-1-1 | 5.0 | 0.015 | 0.500 | Parallel + taper | 0.4 | 2.6 | AA |
| Example 2-1-2 | 3.0 | 0.013 | 0.500 | Parallel + taper | 0.2 | 1.9 | AA |

TABLE 2-continued

| | Length of parallel portion in slit (nm) | Clearance of slit exit d(mm) | Clearance of slit entrance dO(nm) | Shape of slit portion | Layer thickness distribution (%) | Pressure loss (kgf/cm$^2$) | Quality of coating |
|---|---|---|---|---|---|---|---|
| Example 2-1-3 | 1.9 | 0.010 | 0.500 | Parallel + taper | 0.6 | 1.8 | AA |
| Example 2-1-4 | 1.0 | 0.015 | 0.300 | Parallel + taper | 0.3 | 0.5 | AA |
| Example 2-1-5 | 0.7 | 0.015 | 0.300 | Parallel + taper | 0.9 | 0.4 | AA |
| Example 2-1-6 | 0.3 | 0.015 | 0.200 | Parallel + taper | 1.0 | 0.2 | AA |
| Example 2-1-7 | 3.0 | 0.018 | 0.300 | Parallel + taper | 0.4 | 1.2 | A |
| Example 2-1-8 | 3.0 | 0.025 | 0.200 | Parallel + taper | 0.8 | 0.7 | A |
| Example 2-1-9 | 3.0 | 0.035 | 0.100 | Parallel + taper | 0.7 | 0.8 | A |
| Example 2-1-10 | 3.0 | 0.049 | 0.300 | Parallel + taper | 0.7 | 0.4 | A |
| Comparative Example 2-1-4 | 3.0 | 0.052 | 0.300 | Parallel + taper | 3.1 | 0.4 | B |
| Comparative Example 2-1-5 | 3.0 | 0.057 | 0.300 | Parallel + taper | 5.8 | 0.4 | B |
| Comparative Example 2-1-6 | 3.0 | 0.074 | 0.300 | Parallel + taper | — | 0.4 | C |
| Comparative Example 2-1-7 | 3.0 | 0.098 | 0.300 | Parallel + taper | — | 0.4 | C |
| Example 2-1-11 | 3.5 | 0.012 | 0.400 | Step | 0.8 | 2.3 | AA |
| Example 2-1-12 | 3.5 | 0.014 | 0.400 | Step | 0.2 | 1.9 | AA |
| Example 2-1-13 | 1.2 | 0.013 | 0.300 | Step | 0.5 | 0.7 | AA |
| Example 2-1-14 | 0.5 | 0.015 | 0.200 | Step | 0.7 | 0.3 | AA |
| Example 2-1-15 | 0.3 | 0.015 | 0.300 | Step | 1.0 | 0.2 | AA |
| Example 2-1-16 | 3.0 | 0.022 | 0.300 | Step | 0.9 | 1.1 | A |
| Example 2-1-17 | 3.0 | 0.045 | 0.300 | Step | 0.6 | 0.5 | A |
| Example 2-1-18 | 3.0 | 0.050 | 0.200 | Step | 0.8 | 0.5 | A |
| Comparative Example 2-1-8 | 3.0 | 0.063 | 0.200 | Step | 2.7 | 0.4 | B |
| Comparative Example 2-1-9 | 3.0 | 0.081 | 0.100 | Step | 4.1 | 0.3 | B |
| Comparative Example 2-1-10 | 0.0 | 0.013 | 0.500 | Taper | 3.5 | 0.7 | AA |
| Comparative Example 2-1-11 | 0.0 | 0.014 | 0.400 | Taper | 4.2 | 0.9 | AA |
| Comparative Example 2-1-12 | 0.0 | 0.015 | 0.300 | Taper | 5.6 | 1.3 | AA |

Note) Quality of coating
AA: Stable coating is possible. (Lower limit of layer thickness is 5 μm or less.)
A: Stable coating is possible. (Lower limit of layer thickness is 5 μm–10 μm.)
B: Coating is stable after cross-linking of a jetted coating liquid film which, however, is difficult.
C: Coating is impossible or unstable.

TABLE 3

| | Length of parallel portion in slit (nm) | Clearance of slit exit d(mm) | Clearance of slit entrance dO(nm) | Shape of slit portion | Layer thickness distribution (%) | Pressure loss (kgf/cm$^2$) | Quality of coating |
|---|---|---|---|---|---|---|---|
| Comparative Example 2-2-1 | 31.2 | 0.015 | 0.015 | Parallel | — | 10 or more | C |
| Comparative Example 2-2-2 | 14.8 | 0.015 | 0.015 | Parallel | — | 6.2 | C |
| Comparative Example 2-2-3 | 9.7 | 0.015 | 0.015 | Parallel | — | 4.1 | C |
| Example 2-2-1 | 4.8 | 0.015 | 0.500 | Parallel + taper | 0.3 | 1.8 | AA |
| Example 2-2-2 | 3.3 | 0.013 | 0.500 | Parallel + taper | 0.4 | 1.4 | AA |
| Example 2-2-3 | 2.0 | 0.011 | 0.500 | Parallel + taper | 0.4 | 1.0 | AA |
| Example 2-2-4 | 1.0 | 0.014 | 0.300 | Parallel + taper | 0.5 | 0.4 | AA |
| Example 2-2-5 | 0.3 | 0.014 | 0.200 | Parallel + taper | 1.0 | 0.1 | AA |
| Example 2-2-6 | 2.9 | 0.017 | 0.300 | Parallel + taper | 0.4 | 1.0 | A |
| Example 2-2-7 | 2.9 | 0.032 | 0.100 | Parallel + taper | 0.5 | 0.7 | A |
| Example 2-2-8 | 2.9 | 0.050 | 0.300 | Parallel + taper | 0.7 | 0.4 | A |
| Comparative Example 2-2-4 | 2.9 | 0.053 | 0.300 | Parallel + taper | 3.4 | 0.4 | B |
| Comparative Example 2-2-5 | 2.9 | 0.061 | 0.300 | Parallel + taper | 4.9 | 0.4 | B |
| Comparative Example 2-2-6 | 2.9 | 0.086 | 0.300 | Parallel + taper | — | 0.4 | C |
| Example 2-2-9 | 3.3 | 0.013 | 0.400 | Step | 1.0 | 1.6 | AA |
| Example 2-2-10 | 2.8 | 0.014 | 0.400 | Step | 0.3 | 1.3 | AA |
| Example 2-2-11 | 1.0 | 0.012 | 0.300 | Step | 0.7 | 0.5 | AA |
| Example 2-2-12 | 0.5 | 0.015 | 0.300 | Step | 1.0 | 0.2 | AA |

TABLE 3-continued

| | Length of parallel portion in slit (nm) | Clearance of slit exit d(mm) | Clearance of slit entrance dO(nm) | Shape of slit portion | Layer thickness distribution (%) | Pressure loss (kgf/cm$^2$) | Quality of coating |
|---|---|---|---|---|---|---|---|
| Example 2-2-13 | 3.0 | 0.025 | 0.300 | Step | 0.5 | 0.8 | A |
| Example 2-2-14 | 3.0 | 0.038 | 0.300 | Step | 0.7 | 0.5 | A |
| Example 2-2-15 | 3.0 | 0.050 | 0.200 | Step | 0.8 | 0.4 | A |
| Comparative Example 2-2-7 | 3.0 | 0.055 | 0.200 | Step | 3.0 | 0.3 | B |
| Comparative Example 2-2-8 | 3.0 | 0.079 | 0.100 | Step | 2.8 | 0.2 | B |
| Comparative Example 2-2-9 | 0.0 | 0.015 | 0.500 | Taper | 3.3 | 0.6 | AA |
| Comparative Example 2-2-10 | 0.0 | 0.015 | 0.400 | Taper | 5.1 | 0.8 | AA |
| Comparative Example 2-2-11 | 0.0 | 0.015 | 0.300 | Taper | 6.0 | 1.1 | AA |

Note) Quality of coating
AA: Stable coating is possible. (Lower limit of layer thickness is 5 μm or less.)
A: Stable coating is possible. (Lower limit of layer thickness is 5 μm–10 μm.)
B: Coating is stable after cross-linking of a jetted coating liquid film which, however, is difficult.
C: Coating is impossible or unstable.

Example 3

A distance between a coater and a support was set to 0.5 mm, and types of coating liquids (including viscosity and density), a coated layer thickness, coating speed and a clearance of slit exit of an extrusion type coater were changed variously to confirm whether coating can be performed in a stable manner.

Tables 4 and 5 show the results of the foregoing which indicate that stable coating can be carried out when dimensionless number M satisfies the condition of $M=(\rho \cdot U \cdot hw^2)/(\mu \cdot d)>0.2$. Incidentally, neither streak nor uneven coating was caused, and layer thickness distribution was not more than 1% of the layer thickness.

TABLE 4

| | Name of coating liquid | Viscosity ($10^{-3}$ Pa · S) | Density ρ (Kg/m$^3$) | Coated layer thickness hw (μm) | Coating speed U (m/min) | Clearance of slit exit d (μm) | ρ Uhw$^2$/μd (—) | Quality of coating |
|---|---|---|---|---|---|---|---|---|
| Example 3-1 | Pure water | 1 | 1000 | 5 | 100 | 10 | 4.1667 | A |
| Example 3-2 | Pure water | 1 | 1000 | 5 | 100 | 25 | 1.6667 | A |
| Example 3-3 | Pure water | 1 | 1000 | 5 | 100 | 50 | 0.8333 | A |
| Comparative Example 3-1 | Pure water | 1 | 1000 | 5 | 100 | 75 | 0.5556 | B |
| Example 3-4 | Pure water | 1 | 1000 | 5 | 50 | 25 | 0.8333 | A |
| Example 3-5 | Pure water | 1 | 1000 | 5 | 25 | 25 | 0.4167 | A |
| Example 3-6 | Pure water | 1 | 1000 | 2.5 | 100 | 25 | 0.4167 | A |
| Example 3-7 | Pure water | 1 | 1000 | 2.5 | 200 | 25 | 0.8333 | A |
| Example 3-8 | Pure water | 1 | 1000 | 1 | 500 | 25 | 0.3333 | A |
| Example 3-9 | Pure water | 1 | 1000 | 1 | 1000 | 25 | 0.6667 | A |
| Comparative Example 3-2 | Pure water | 1 | 1000 | 1.2 | 100 | 25 | 0.0960 | C |
| Example 3-10 | Latex | 1.2 | 997 | 5 | 100 | 25 | 1.3847 | A |
| Example 3-11 | Latex | 1.2 | 997 | 2 | 100 | 25 | 0.2216 | A |
| Example 3-12 | Latex | 1.2 | 997 | 2 | 200 | 25 | 0.4431 | A |
| Example 3-13 | Latex | 1.2 | 997 | 1 | 500 | 25 | 0.2769 | A |
| Example 3-14 | Latex | 1.2 | 997 | 1 | 1000 | 25 | 0.5539 | A |
| Comparative Example 3-3 | Latex | 1.2 | 997 | 1.5 | 100 | 25 | 0.1246 | C |
| Example 3-15 | Latex | 1.2 | 997 | 5 | 25 | 25 | 0.3462 | A |
| Example 3-16 | Acetone | 0.37 | 790 | 2.5 | 100 | 25 | 0.8896 | A |
| Example 3-17 | Acetone | 0.37 | 790 | 1.2 | 100 | 25 | 0.2050 | B |
| Comparative Example 3-4 | Acetone | 0.37 | 790 | 1 | 100 | 25 | 0.1423 | C |
| Example 3-18 | Acetone | 0.37 | 790 | 1 | 200 | 25 | 0.2847 | A |
| Example 3-19 | Acetone | 0.37 | 790 | 1 | 500 | 25 | 0.7117 | A |
| Example 3-20 | Acetone | 0.37 | 790 | 1 | 1000 | 25 | 1.4234 | A |
| Example 3-21 | Acetone | 0.37 | 790 | 2.5 | 25 | 25 | 0.2224 | A |
| Comparative Example 3-5 | Acetone | 0.37 | 790 | 1.5 | 25 | 25 | 0.0801 | C |
| Example 3-22 | Cyclohexanone | 2.45 | 950 | 5 | 50 | 25 | 0.3231 | A |
| Example 3-23 | Cyclohexanone | 2.45 | 950 | 3 | 100 | 25 | 0.2327 | A |

TABLE 4-continued

| | Name of coating liquid | Viscosity ($10^{-3}$ Pa · S) | Density ρ (Kg/m$^3$) | Coated layer thickness hw (μm) | Coating speed U (m/min) | Clearance of slit exit d (μm) | ρ Uhw$^2$/μd (—) | Quality of coating |
|---|---|---|---|---|---|---|---|---|
| Example 3-24 | Cyclohexanone | 2.45 | 950 | 2 | 200 | 25 | 0 2068 | A |
| Example 3-25 | Cyclohexanone | 2.45 | 950 | 1.5 | 500 | 25 | 0.2908 | A |
| Example 3-26 | Cyclohexanone | 2.45 | 950 | 1 | 1000 | 25 | 0.2585 | A |
| Comparative Example 3-6 | Cyclohexanone | 2.45 | 950 | 2.5 | 100 | 25 | 0.1616 | B |

Note Quality of coating A: Stable coating is possible.
B: Coating is stable after cross-linking of a jetted coating liquid film which, however, is difficult.
C: Coating is impossible or unstable.

TABLE 5

| | Name of coating liquid | Viscosity ($10^{-3}$ Pa · S) | Density ρ (Kg/m$^3$) | Coated layer thickness hw (μm) | Coating speed U (m/min) | Clearance of slit exit d (μm) | ρ Uhw$^2$/μd (—) | Quality of coating |
|---|---|---|---|---|---|---|---|---|
| Comparative Example 3-7 | Carbon-dispersed liquid | 12 | 1100 | 5 | 100 | 25 | 0.1528 | C |
| Example 3-27 | Carbon-dispersed liquid | 12 | 1100 | 5 | 150 | 25 | 0.2292 | A |
| Example 3-28 | Carbon-dispersed liquid | 12 | 1100 | 5 | 200 | 25 | 0.3056 | A |
| Example 3-29 | Carbon-dispersed liquid | 12 | 1100 | 3 | 500 | 25 | 0.2750 | A |
| Example 3-30 | Carbon-dispersed liquid | 12 | 1100 | 2 | 1000 | 25 | 0.2444 | A |
| Example 3-31 | Carbon-dispersed liquid | 12 | 1100 | 7.5 | 100 | 25 | 0.3437 | A |
| Example 3-32 | Carbon-dispersed liquid | 12 | 1100 | 10 | 100 | 25 | 0.6111 | A |
| Example 3-33 | Carbon-dispersed liquid | 12 | 1100 | 5 | 100 | 20 | 0.1910 | A |
| Example 3-34 | Carbon-dispersed liquid | 12 | 1100 | 5 | 100 | 15 | 0.2546 | A |
| Comparative Example 3-8 | Magnetic coating (1) | 50 | 1000 | 5 | 100 | 25 | 0.0333 | C |
| Comparative Example 3-9 | Magnetic coating (1) | 50 | 1000 | 10 | 100 | 25 | 0.1333 | C |
| Example 3-35 | Magnetic coating (1) | 50 | 1000 | 15 | 100 | 25 | 0.3000 | A |
| Example 3-36 | Magnetic coating (1) | 50 | 1000 | 20 | 100 | 25 | 0.5333 | A |
| Example 3-37 | Magnetic coating (1) | 50 | 1000 | 10 | 200 | 25 | 0.2667 | A |
| Example 3-38 | Magnetic coating (1) | 50 | 1000 | 7.5 | 500 | 25 | 0.3750 | A |
| Example 3-39 | Magnetic coating (1) | 50 | 1000 | 5 | 1000 | 25 | 0.3333 | A |
| Comparative Example 3-10 | Magnetic coating (1) | 50 | 1000 | 10 | 100 | 20 | 0.1667 | B |
| Example 3-40 | Magnetic coating (1) | 50 | 1000 | 10 | 100 | 15 | 0.2222 | A |
| Comparative Example 3-11 | Magnetic coating (2) | 150 | 1200 | 5 | 100 | 25 | 0.0133 | C |
| Comparative Example 3-12 | Magnetic coating (2) | 150 | 1200 | 10 | 100 | 25 | 0.0533 | C |
| Example 3-41 | Magnetic coating (2) | 150 | 1200 | 20 | 100 | 25 | 0.2133 | B |
| Example 3-42 | Magnetic coating (2) | 150 | 1200 | 15 | 200 | 25 | 0.2400 | A |
| Example 3-43 | Magnetic coating (2) | 150 | 1200 | 10 | 500 | 25 | 0.2667 | A |
| Example 3-44 | Magnetic coating (2) | 150 | 1200 | 7.5 | 1000 | 25 | 0.3000 | A |
| Comparative Example 3-13 | Magnetic coating (2) | 150 | 1200 | 10 | 200 | 25 | 0.1067 | C |
| Comparative Example 3-14 | Magnetic coating (2) | 150 | 1200 | 10 | 200 | 15 | 0.1778 | B |
| Example 3-45 | Magnetic coating (2) | 150 | 1200 | 10 | 200 | 12 | 0.2222 | A |

Note Quality of coating A: Stable coating is possible.
B: Coating is stable after cross-linking of a jetted coating liquid film which, however, is difficult.
C: Coating is impossible or unstable.

Incidentally, as shown in Tables 4 and 5, it was found that when a clearance of slit exit exceeds 75 μm in the test, cross-linking is slightly difficult, but coating is stable after the cross-linking is achieved, though there is no problem when the clearance of slit exit is not more than 50 μm. It was also confirmed that the lower limit of the clearance of slit exit which makes the cross-linking possible is 10 μm. It is therefore preferable that the clearance of slit exit is not more than 50 μm. Incidentally, it is preferable, from the viewpoint of keeping machining accuracy, that the clearance of slit exit is not less than 5 μm.

Example 4

Coating Conditions Coating Speed: 100 m/min
Clearance of slit exit: 15 μm

A distance between an edge portion of a coater and a support was changed variously, and a ratio of the distance to the coated layer thickness and the relation between distribution of the coated layer thickness and the number of occurrence of streak defects were confirmed.

The results of the example are shown in Table 6 which indicates that when the distance between the edge portion of the coater and a support is 2.5 times the coated layer thickness or more, or preferably 5 times the coated layer thickness or more for coating, accuracy of the distance is improved and the distance hardly affects layer thickness distribution, resulting in excellent coating with no occurrence of streak defects.

TABLE 6

| | Coating liquid | Coated layer thickness (μm) | Coater - support distance (μm) | Distance/ layer thickness | Number of streaks (lines) | Layer thickness distribution (%) |
|---|---|---|---|---|---|---|
| Comparative Example 4-1 | Magnetic coating (1) | 10 | 10 | 1.0 | 16 | 12 |
| Comparative Example 4-2 | Magnetic coating (1) | 10 | 15 | 1.5 | 5 | 5 |
| Comparative Example 4-3 | Magnetic coating (1) | 10 | 20 | 2.0 | 2 | 2 |
| Example 4-1 | Magnetic coating (1) | 10 | 25 | 2.5 | 0 | 1 |
| Example 4-2 | Magnetic coating (1) | 10 | 30 | 3.0 | 0 | 0.8 |
| Example 4-3 | Magnetic coating (1) | 10 | 40 | 4.0 | 0 | 0.5 |
| Example 4-4 | Magnetic coating (1) | 10 | 50 | 5.0 | 0 | 0.2 |
| Example 4-5 | Magnetic coating (1) | 10 | 75 | 7.5 | 0 | 0.1 |
| Example 4-6 | Magnetic coating (1) | 10 | 100 | 10.0 | 0 | 0.1 |
| Example 4-7 | Magnetic coating (1) | 10 | 200 | 20.0 | 0 | 0 |
| Example 4-8 | Magnetic coating (1) | 10 | 500 | 50.0 | 0 | 0 |
| Example 4-9 | Magnetic coating (1) | 10 | 1000 | 100.0 | 0 | 0 |
| Comparative Example 4-4 | Magnetic coating (1) | 15 | 20 | 1.3 | 4 | 7 |
| Comparative Example 4-5 | Magnetic coating (1) | 15 | 25 | 1.7 | 2 | 5 |
| Comparative Example 4-6 | Magnetic coating (1) | 15 | 30 | 2.0 | 1 | 2 |
| Example 4-10 | Magnetic coating (1) | 15 | 40 | 2.7 | 0 | 0.5 |
| Example 4-11 | Magnetic coating (1) | 15 | 75 | 5.0 | 0 | 0.2 |
| Example 4-12 | Magnetic coating (1) | 15 | 100 | 6.7 | 0 | 0.1 |
| Example 4-13 | Magnetic coating (1) | 15 | 200 | 13.3 | 0 | 0 |
| Example 4-14 | Magnetic coating (1) | 15 | 500 | 33.3 | 0 | 0 |
| Example 4-15 | Magnetic coating (1) | 15 | 1000 | 66.7 | 0 | 0 |
| Example 4-16 | Magnetic coating (1) | 15 | 1500 | 100.0 | 0 | 0 |
| Comparative Example 4-7 | Carbon-dispersed liquid | 5 | 5 | 1.0 | 28 | 18 |
| Comparative Example 4-8 | Carbon-dispersed liquid | 5 | 7.5 | 1.5 | 10 | 10 |
| Comparative Example 4-9 | Carbon-dispersed liquid | 5 | 10 | 2.0 | 4 | 4 |
| Example 4-17 | Carbon-dispersed liquid | 5 | 12.5 | 2.5 | 0 | 2 |
| Example 4-18 | Carbon-dispersed liquid | 5 | 20 | 4.0 | 0 | 1.1 |
| Example 4-19 | Carbon-dispersed | 5 | 25 | 5.0 | 0 | 0.5 |
| Example 4-20 | Carbon-dispersed liquid | 5 | 30 | 6.0 | 0 | 0.2 |
| Example 4-21 | Carbon-dispersed liquid | 5 | 50 | 10.0 | 0 | 0.1 |
| Example 4-22 | Carbon-dispersed liquid | 5 | 100 | 20.0 | 0 | 0.1 |
| Example 4-23 | Carbon-dispersed liquid | 5 | 500 | 100.0 | 0 | 0 |
| Comparative Example 4-10 | Carbon-dispersed liquid | 10 | 10 | 1.0 | 9 | 7.5 |
| Comparative Example 4-11 | Carbon-dispersed liquid | 10 | 15 | 1.5 | 5 | 3 |
| Comparative Example 4-12 | Carbon-dispersed liquid | 10 | 20 | 2.0 | 2 | 1.2 |
| Example 4-24 | Carbon-dispersed liquid | 10 | 25 | 2.5 | 0 | 0.8 |
| Example 4-25 | Carbon-dispersed liquid | 10 | 30 | 3.0 | 0 | 0.5 |
| Example 4-26 | Carbon-dispersed liquid | 10 | 50 | 5.0 | 0 | 0.2 |
| Example 4-27 | Carbon-dispersed liquid | 10 | 75 | 7.5 | 0 | 0.2 |
| Example 4-28 | Carbon-dispersed liquid | 10 | 100 | 10.0 | 0 | 0.1 |
| Example 4-29 | Carbon-dispersed liquid | 10 | 200 | 20.0 | 0 | 0.1 |
| Example 4-30 | Carbon-dispersed liquid | 10 | 500 | 50.0 | 0 | 0 |
| Example 4-31 | Carbon-dispersed liquid | 10 | 1000 | 100.0 | 0 | 0 |

Note) Values in the column of "Number of streaks (lines)" are represented by the number per coating width of 1 m and coating length of 1000 m.

Example 5

Slit portions of a coater were made to be different each other in terms of material, using various kinds of materials, and they were used for coating. In the coating, a slit was disassembled and cleaned for each coating length of 25000 m, and the coater was assembled again with the cleaned slit. Coating samples taken immediately after the assembly of the coater were subjected to measurement of the number of foreign materials generated. The relation between Vickers hardness of the slit member and the number of generated foreign materials was confirmed.

Incidentally, coating speed was 100 m/min, coated layer thickness was 10 $\mu$m, slit shape was "parallel+taper" as shown in FIG. 4(*c*) and its length was 50 mm, length of a parallel portion L was 3 mm, clearance of slit exit d was 0.015 mm and slit entrance $d_0$ was 0.3 mm. The coating liquid used was magnetic coating (1). The distance between the edge of the coater and a support was 0.5 mm.

The results obtained are shown in Table 7 which indicates that the number of foreign materials generated in long run coating is small when Vickers hardness is 280 or more.

TABLE 7

| | Vickers hardness | Number of foreign materials for 25000 m (pieces) | Number of foreign materials for 50000 m (pieces) | Number of foreign materials for 75000 m (pieces) | Number of foreign materials for 100000 m (pieces) | Materials |
|---|---|---|---|---|---|---|
| Example 5-1 | 550 | 0 | 0 | 0 | 0 | SUS420-J2 (quenched) |
| Example 5-2 | 332 | 0 | 1 | 0 | 1 | SUS420-J2 (not quenched) |
| Example 5-3 | 319 | 0 | 0 | 1 | 0 | SCM 1 |
| Example 5-4 | 296 | 0 | 1 | 1 | 1 | SCM 1 |
| Example 5-5 | 283 | 0 | 1 | 2 | 2 | SCM 1 |
| Comparative Example 5-1 | 264 | 2 | 9 | 12 | 17 | SCM 1 |
| Comparative Example 5-2 | 245 | 7 | 20 | — | — | SNC 1 |
| Comparative Example 5-3 | 224 | 10 | 21 | — | — | SNC 1 |
| Comparative Example 5-4 | 192 | 12 | 27 | — | — | SUS304 |

The invention has made it possible to coat a thin layer at high speed on a stable manner through a coating method which is not affected by deformation of a support such as partial slack and a wrinkle caused by the slack and generates no streaks. Further, the slit shape of the coater in a coating apparatus of the invention has made it possible to obtain a uniform coated layer thickness easily.

Further, since the coated layer thickness is hardly affected by roundness of a back roll, flapping and a wrinkle caused by the slack of a support, and straightness and bending of an edge of a coater, their accuracy has nothing to do with coating, making the reduction of apparatus cost, easy management and easy operation and job possible.

What is claimed is:

1. A coating apparatus comprising:

(a) a conveyor which conveys an object to be coated; and (b) a coater including a slit having a slit inlet through which a coating liquid is injected and a slit exit through which the coating liquid is jetted, whereby the coating liquid jetted through the slit exit becomes a film shape between the slit exit and the object, the coating liquid colliding with the object at a collision speed V (m/s), wherein the coater is in non-contact with the coating liquid coated on the object to be coated, the collision speed satisfies a relation of V (m/s)=U·hw/d, and a clearance of a slit exit d (m) of the coater satisfies a relation of $0<d\leqq 5\times 10^{-5}$ (m) and $d<(\rho\cdot U\cdot hw^2)/(0.2\mu)$, where $\mu$(PA·s) is a viscosity of the coating liquid, ρ (kg/m3) is a density of the coating liquid, U (m/s) is a coating speed and hw (m) is a coated laver wet thickness, and wherein the clearance of the slit exit of the coater is smaller than a clearance of the slit inlet, the slit has, on a side of the slit exit, slit side surfaces which face each other and which are in parallel.

2. The coating apparatus of claim 1, wherein the conveyor conveys the object so as to be spaced apart by at least 2.5 times the coated layer wet thickness.

3. The coating apparatus of claim 1, wherein the slit exit jets the coating liquid so that the coating liquid jetted forms a cross-link portion in a film shape between the slit exit and the object to be coated.

4. The coating apparatus of claim 1, wherein the slit side surfaces on the side of the slit exit has a part whose Vickers hardness is at least 280.

5. A coater comprising:

a coating head for coating a coating liquid, in non-contact with the coating liquid coated on an object to coated, onto the object, including a slit having a slit exit through which a coating liquid is jetted, whereby the coating liquid jetted through the slit exit becomes a film shape between the slit exit and the object, the coating liquid colliding with the object at a collision speed V (m/s) which satisfies a relation of V (m/s)=U·hw/d, having a clearance of d (m) satisfying a relation of $0<d\cdot\leqq 5\times 10^{-5}$ (m) and $d<(\rho\cdot U\cdot hw^2/(0.2\mu)$, where $\mu$(PA·s) is a viscosity of the coating liquid, ρ (kg/m3) is a density of the coating liquid, U (m/s) is a coating speed and hw (m) is a coated layer wet thickness; and a slit inlet through which the coating liquid is infected, wherein a clearance of the slit exit is smaller than a clearance of the slit inlet through which the coating liquid is injected, and the slit has, on a side of the slit exit, slit side surfaces which face each other and which are in parallel.

6. The coater of claim 5, wherein the slit side surfaces on the side of the slit exit has a part whose Vickers hardness is at least 280.

* * * * *